United States Patent [19]

Ford

[11] 4,057,118

[45] Nov. 8, 1977

[54] BIT PACKER FOR DUAL TUBE DRILLING

[75] Inventor: George Alan Ford, Houston, Tex.

[73] Assignee: Walker-Neer Manufacturing Co., Inc., Wichita Falls, Tex.

[21] Appl. No.: 618,811

[22] Filed: Oct. 2, 1975

[51] Int. Cl.[2] ..... E21B 17/00; E21B 17/04; E21B 21/00

[52] U.S. Cl. ..... 175/215; 166/152; 166/334; 175/243; 175/317; 175/325

[58] Field of Search ..... 175/215, 325, 317, 232, 175/23 X, 235, 243, 107, 296; 166/226, 150, 152, 141, 316, 334

[56] References Cited

U.S. PATENT DOCUMENTS

| | | | |
|---|---|---|---|
| 2,602,516 | 7/1952 | Gray | 175/317 X |
| 2,663,545 | 12/1953 | Grable | 175/317 X |
| 2,882,019 | 4/1959 | Carr et al. | 175/317 X |
| 2,942,667 | 6/1960 | Blood et al. | 175/325 X |
| 3,094,176 | 6/1963 | Cook | 175/296 X |
| 3,151,690 | 10/1964 | Grable | 175/215 X |
| 3,155,179 | 11/1964 | Hunt et al. | 175/215 |
| 3,283,835 | 11/1966 | Kellner | 175/215 X |
| 3,722,608 | 3/1973 | Faulk | 175/107 X |
| 3,823,788 | 7/1974 | Garrison et al. | 175/215 X |

*Primary Examiner*—Stephen J. Novosad
*Attorney, Agent, or Firm*—Robert L. Harmon

[57] ABSTRACT

A bit packer for use with a string of dual concentric drill pipe, having inner and outer tubular members concentrically arranged to mate with the inner and outer pipes of the drill string to provide an annular conduit for fluid from surface to bit and a central conduit for fluid and cuttings from bit to surface, is particularly characterized by flexible packing means mounted slidably and rotatably on the outer tubular member. The packing means deform against the hole wall to seal the annular space between the outer member and the hole wall. Upper and lower ports provide fluid communication between the annular conduit and the annular space; when the packer is moved downwardly in the hole the packing means slides upwardly to close the upper port and open the lower port; when the packer is moved upwardly in the hole, the converse occurs. A milling collar is provided above the packing means.

10 Claims, 9 Drawing Figures

BIT PACKER FOR DUAL TUBE DRILLING

BACKGROUND OF THE INVENTION

Reverse circulation drilling with dual concentric drill pipe has become an accepted technique, with many advantages over conventional drilling. A system for reverse circulation dual tube drilling is disclosed in Henderson U.S. Pat. No. 3,208,539. The advantages of this technique include virtual elimination of lost-circulation problems, reduction in power and drilling fluid needs, virtually complete recovery of uncontaminated cuttings, and the capability for continuous core recovery.

In reverse circulation dual tube drilling systems, the drilling fluid is pumped from the surface to the bit through an annular space defined between the inner and outer concentric drill pipes. The fluid, with entrained cuttings returns to the surface through the inner pipe.

In such systems, it becomes important in many drilling applications to insure that the drilling fluid is forced to return to the surface through the inner pipe, and steps must be taken to prevent the fluid from passing upward in the annular space between the outer pipe and the hole wall. Several techniques have been developed in an attempt to accomplish this purpose. For example, heavy static fluids have been placed in the hole annulus to prevent upward flow of drilling fluid therein. Mechanical means, such as shrouded or skirted bits and bit subs are disclosed in Henderson U.S. Pat. No. 2,819,043, Elenburg U.S. Pat. No. 3,439,757, and Elenburg U.S. Reissue Pat. No. 27,316. These mechanical structures suffer several disadvantages. First, they rotate with the drill string and are consequently abraded by the hole wall, resulting in shortened life. Second, they must necessarily be of the same or slightly less diameter than the effective cutting diameter of the bit, thus inherently resulting in an imperfect seal. Finally, they are subject to sticking and lodging in the hole due to the passage of small cuttings from the hole bottom and the accumulation of detritus from above.

SUMMARY OF THE INVENTION

The present invention provides a means for effectively sealing or packing the hole annulus which overcomes the disadvantages of prior art techniques and apparatus. This is achieved by providing a sub which includes fluid passageways for communicating with the annular conduit between the inner and outer pipes and of the drill string to provide a path for fluid from the surface to the bit, and with the inner pipe of the string to provide a return path for fluid and cuttings from bit to surface. A flexible packing means, preferably a plurality of flexible rings or disks, is mounted on the sub body. The packing means is of a greater diameter than the hole, and deforms against the hole wall to provide a seal between the sub body and the hole wall. The packing means is arranged to rotate with respect to the sub body, so that as the drill string rotates the packing means remains stationary with respect to the hole wall.

The packing means is also arranged to slide upwardly and downwardly with respect to the sub body. This sliding movement of the packing means opens and closes a port which provides fluid communication between the pipe annulus and the hole annulus. Thus, when the bit is moved downwardly into cutting position at the bottom of the hole, the packing means slides upwardly to close the port and block the flow fluid into the hole annulus. When the drill string is lifted up from the hole bottom, the packing means slides downwards, opening the port and permitting drilling fluid to flow from the pipe annulus into the hole annulus and upwardly to the surface, thus facilitating the withdrawal of the drill string and other down hole equipment. A milling collar may be provided above the sub to ream or mill the hole wall as the string is withdrawn, and the upward passage of drilling fluid in the hole annulus facilitates this milling process and carries cuttings to the surface in the hole annulus.

When the bit packer of the present invention is to be used with a conventional bit, such as a typical tri-cone rock bit, a second port may be provided in the sub body, spaced a sufficient distance below the first so that when the first is closed the second is opened. This second port, then, provides a passage for drilling fluid from the pipe annulus to the hole annulus in the vicinity of the bit. If it is desired to use a jet-type tri-cone rock bit, the second port may be dispensed with, and a passageway provided in the sub for fluid communication between the pipe annulus and the entrance orifices of the jet bit. In another form of the invention, passageways may be provided in the packer sub to provide fluid communication with an air hammer or hydraulic motor to drive a reciprocating or rotating bit.

The general object of the present invention is to provide a means for sealing the hole annulus above the bit so that virtually all of the drilling fluid will be forced to return to the surface through the inner pipe of the dual concentric drill string. Other objects of the invention will become apparent upon consideration of the following description, with reference to the appended drawings, in which.

DESCRIPTION

Figure 1:
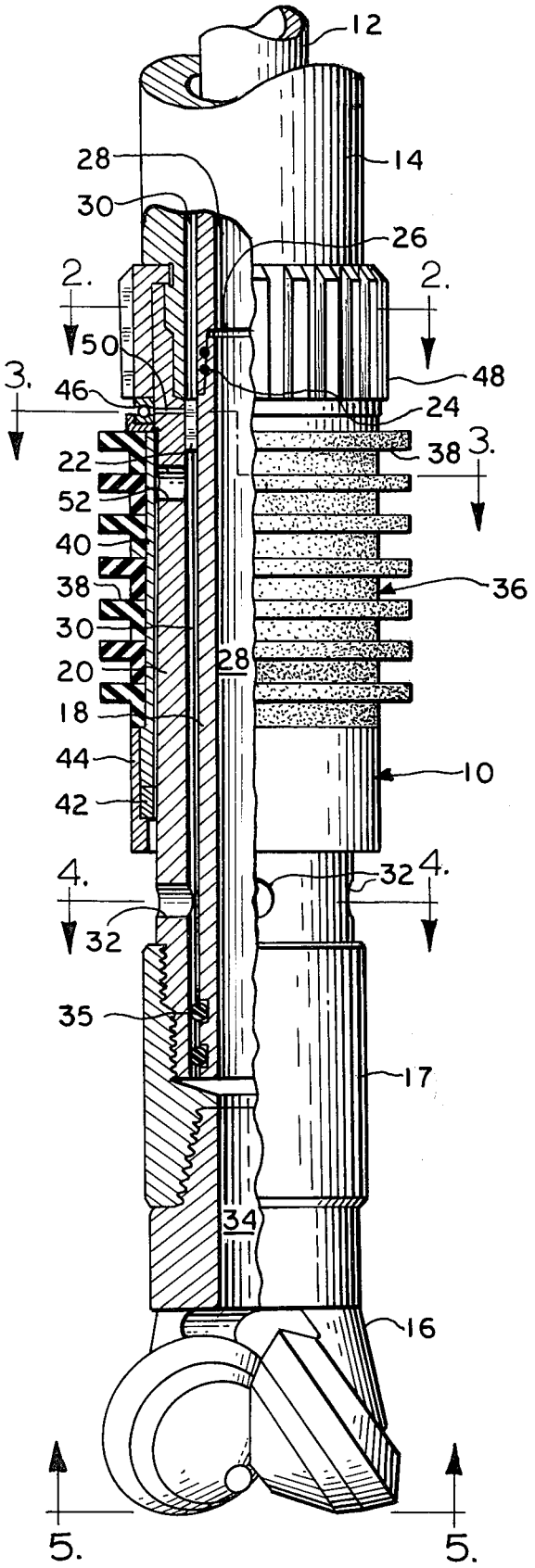
FIG. 1 is an elevational view, partially in section, showing a bit packer embodying the present invention.
Figure 2:
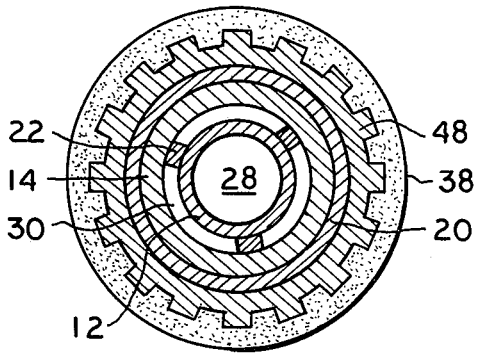
FIG. 2 is a transverse cross sectional view taken on the line 2—2 of FIG. 1.
Figure 3:
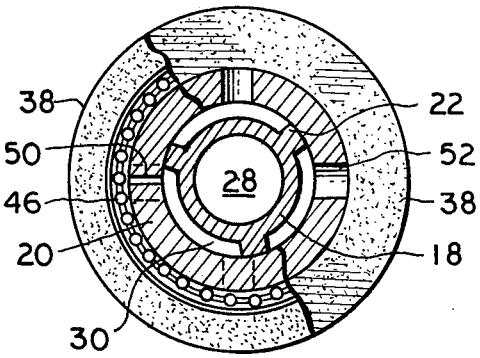
FIG. 3 is a cross sectional view, partially broken away, taken on the line 3—3 of FIG. 1.
Figure 4:
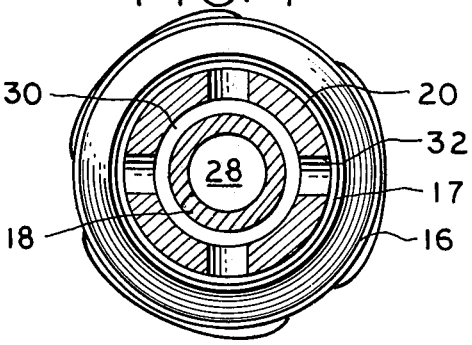
FIG. 4 is a transverse cross sectional view taken on the line 4—4 of FIG. 1.
Figure 5:
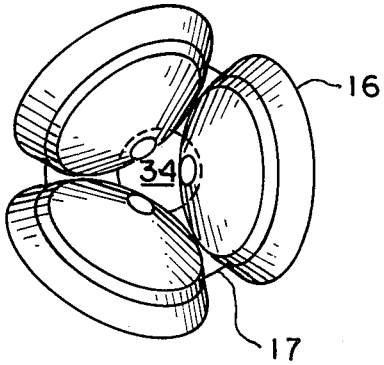
FIG. 5 is an end view taken on the line 5—5 of FIG. 1.

With reference to the drawings, there is shown in FIGS. 1-5, as an example of one form in which the present invention may be embodied, a bit packer or sub generally designated by the numeral 10. The bit packer 10 is adapted for interconnection with a string of dual tube concentric drill pipe having an inner pipe 12 and an outer pipe 14. At the bottom of the bit packer 10 is a conventional tri-cone rock bit 16, attached thereto by means of a connecting sub 17.

The bit packer includes an inner tubular member 18, concentrically disposed within an outer tubular member 20. The members 18 and 20 are maintained in concentric relationship by a spider or lugs 22. The inner and outer members 18 and 20 are preferably attached together at one point only (as by the lugs 22), or along only a limited portion of their length, or otherwise include means to accommodate relative expansion or contraction of the two members, as disclosed in Henderson U.S. Pat. No. 3,209,539.

The inner pipe 12 of the drill string mates telescopically with the upper end of the inner tubular member 18, and O-rings or other appropriate means are employed to provide a fluid tight seal. A gap 26 is preferably provided to accommodate a limited degree of axial movement of the members 12 and 18, also as disclosed in Henderson U.S. Pat. No. 3,208,539.

As can be seen, the respective interconnection of the tubular members 18 and 20 with the pipes 12 and 14 provide a continuous inner conduit 28 and a continuous annular conduit 30. A series of ports 32 in the outer tubular member 20 provide passageways for drilling fluid to pass between the annular conduit 30 and the space outside the sub 10 in the vicinity of the bit 16. This outer space will normally be an annular one, defined by the hole wall. Thus drilling fluid passes from the surface down through the pipe annulus 30, out the ports 32 and down in the hole annulus to the bit 16. The fluid provides cooling and lubricating for the cutting process and then passes upwardly through a central opening 34 in the bit 16 and on into the central conduit or passageway 28. In this manner, the entrained cuttings are carried to the surface through the interior of the pipe 12. The lower end of the annular conduit 30 is sealed by O-rings 35.

A packing means, generally designated by the numeral 36, encircles the outer tubular member 20. The requisites for the packing means 36 are that it be generally circular in section, flexible, and of a diameter greater than that of the hole being cut by the bit 16. One suitable packing means, as shown in FIG. 1, can take the form of a series of flexible rings or disks 38. These rings may be formed of rubber, plastic, fiber or other suitable material possessing sufficient flexibility to provide a tight seal upon contact with the hole wall. Interposed between packing disks 38 and the outer tubular member 20 is a mounting sleeve 40 to which the disks 38 are affixed. There is sufficient clearance between the sleeve 40 and the member 20 to permit the packing means 36 to rotate with respect to the member 20. Thus as the drill string rotates within the hole, the packing means 36 is held stationary with respect to the hole by means of frictional contact between the packing rings 38 and the hole wall. A sleeve bearing 42 is held in place with a retaining member 44 which may take the form of a nut threaded onto the sleeve 40.

At the upper end of the packing means a thrust bearing 46 is provided, for roational bearing against a fluted milling collar 48. The milling collar 48 is mounted stationary with respect to the outer pipe 14 and the outer tubular member 20 and rotates therewith. Cooling, flushing and lubrication for the thrust bearing 46 is provided by a passageway 50 which permits drilling fluid to flow from the annular conduit 30 to the bearing 46. In like manner, cooling, flushing and lubrication for the sleeve 40 and the bearing 42 is provided by means of a series of ports 52 which similarly permit drilling fluid to pass from the annular conduit 30 to the clearance space between the sleeve 40 and the tubular member 20 and thence to the bearing 42.

Figure 6:
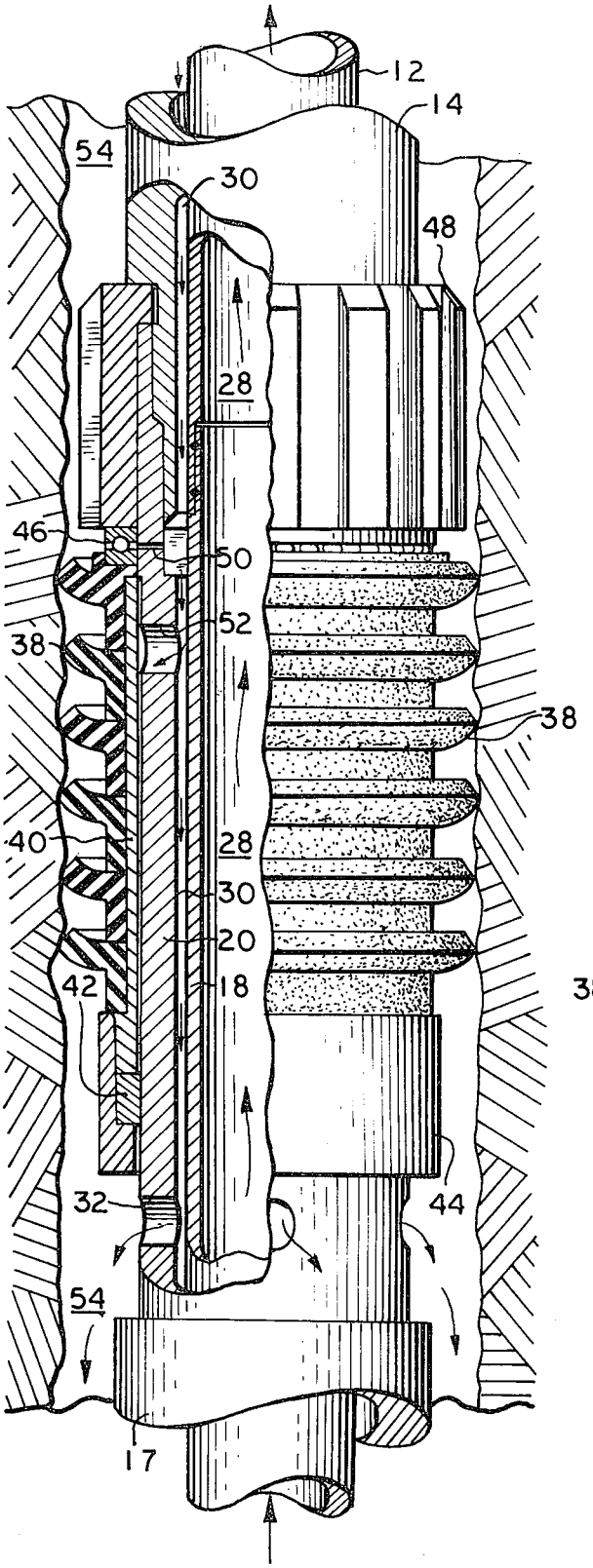
FIG. 6 is an elevational view, partially in section, of the bit packer of FIG. 1, showing the apparatus being moved downwardly in the hole or in drilling position in the bottom of the hole.
Figure 7:
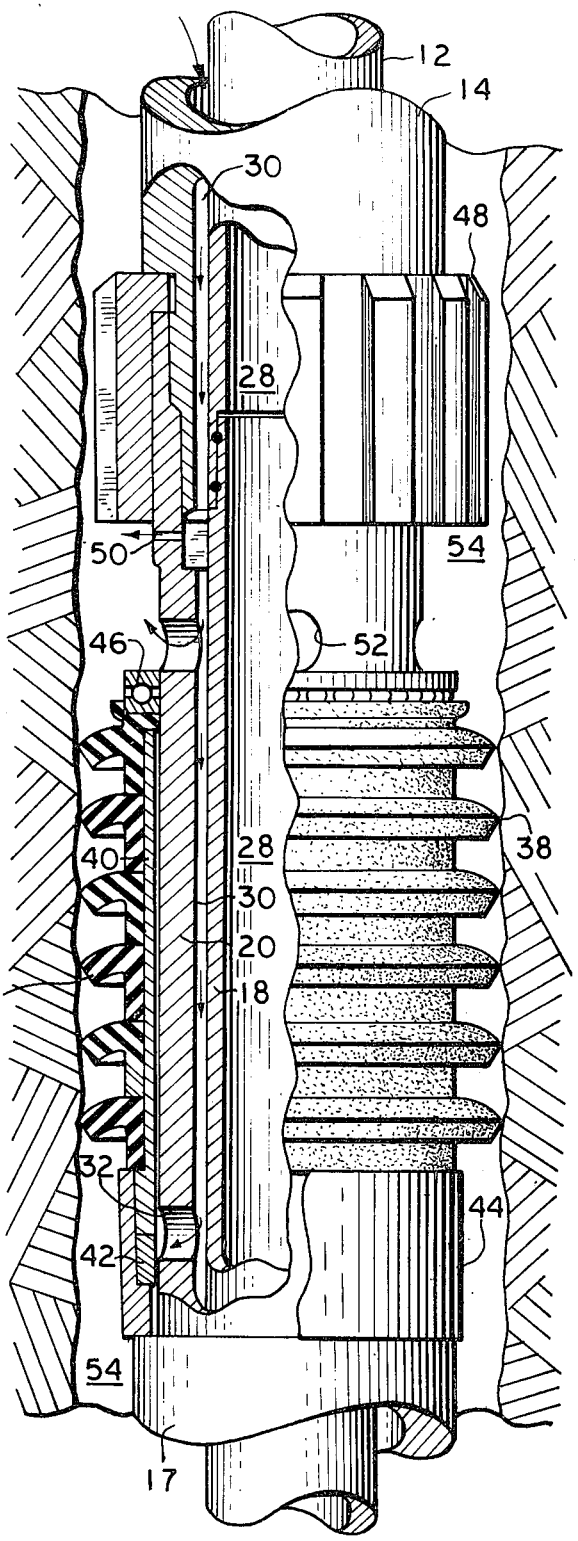
FIG. 7 is a view similar to FIG. 6, showing the apparatus being moved downwardly in the hole.

The ports 52 provide another function, as can best be seen by reference to FIGS. 6 and 7, in which the direction of fluid flow is shown by the arrows. As can be seen therein, the packing means 36 is slidable upwardly and downwardly with respect to the outer tubular member 20. In FIG. 6, the bit packer sub is shown in the hole, as it would appear when being moved downwardly or subsequent to a downward movement. Thus, drilling fluid flows from the surface through the pipe annulus 30 and out the ports 32 into the hole annulus 54. The fluid continues down around the bit 16 (not shown), assisting in the cutting process and entraining cuttings. The fluid returns up the central opening 34 in the bit, into the inner conduit or passage 28 formed by the inner tubular member 18 and the inner pipe 12, and thence to the surface, carrying with it entrained cuttings from the bottom of the hole. The packing rings 38 are deformed by contact with the hole, thus providing an effective barrier or seal to the flow of drilling fluid upwardly in the hole annulus. The ports 52 are closed by the packing means 36, in particular by the sleeve 40, and the only fluid flow through the ports 52 is into the clearance space between the sleeve 40 and the tubular member 20. Small amounts of fluid also may flow through the passageway 50 into the bearing 46.

FIG. 7 depicts the bit packer as it would appear when the drill string is being moved upwardly in the hole or subsequent to such a movement. Due to frictional contact of the packing rings 38 with the hole wall, the entire packing means 36 has been caused to slide downwardly with respect to the body of the sub, thus closing the ports 32 and opening the ports 52. Fluid now is permitted to flow from the pipe annulus 30 out through the ports 52 and into the hole annulus 54. The only fluid flow through the ports 32 is into the clearance space between the sleeve 40 and the tubular member 20. Again, small amounts of fluid may flow through the passageway 50 into the hole annulus 54.

As the drill string is lifted upwardly and rotated, the milling cutter 48 serves to clean the hole and remove any detritus which may be accumulated above the bit packer sub 10. The flow of drilling fluid is all upward past the milling cutter 48 and this serves to carry cuttings and detritus to the surface.

In this manner, the drilling fluid is always directed to the precise area where it is more needed and where it may be most efficiently utilized to remove cuttings from the hole. When the bit 16 is operating at the bottom of the hole, virtually all of the drilling fluid flows downward in the pipe annulus 30, out the ports 32 into the hole 54 and up through the central opening 34 in the bit 16, carrying the cuttings to the surface. Conversely, when the drill string is being withdrawn from the hole virtually all of the drilling fluid flows out through the ports 52, above the packing means 36 and carries cuttings and detritus from the milling collar 48 upward through the hole annulus 54 to the surface.

It should be understood that the packing means 36 need not take the form shown in the drawings. Any structure which is generally circular in cross section and sufficiently flexible to deform against the hole wall to provide an adequate seal may be employed. For example, a rubber torus, or inflatable bag could be employed.

Figure 8:
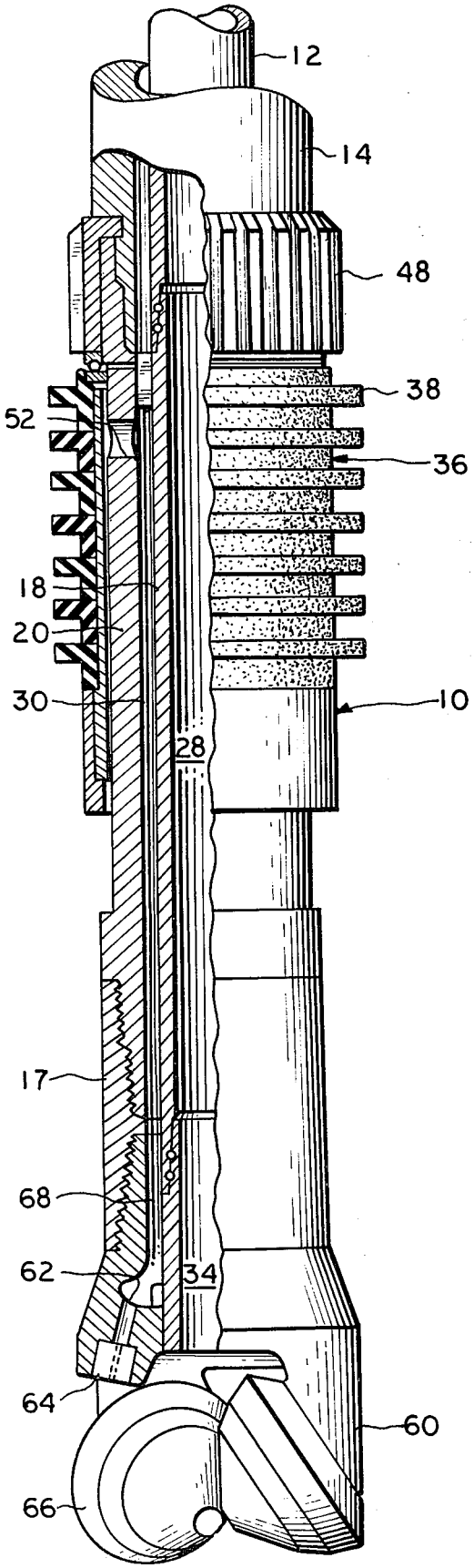
FIG. 8 is a view similar to FIG. 1 showing an alternative construction also embodying the invention.

FIG. 8 illustrates a bit packer 10 of the general construction shown in FIG. 1, which has been modified for use with a jet type rock bit 60. Such bits are constructed with fluid entrance orifices 62 and jet nozzles 64 so that the drilling fluid is directed forcefully onto the cutter cones 66 of the bit.

Accordingly, in the embodiment shown in FIG. 8, the ports 32 in the tubular member 20 have been eliminated, and the annular passageway 30 extended downwardly to communicate with a corresponding annular passageway or series of orifices 68 in the bit 60. Thus, the drilling fluid is not, during the cutting mode, discharged into the hole annulus but rather is routed directly through the jet nozzle 64 onto the cutter 66 of the bit 60.

Otherwise, the operation of the bit packer shown in FIG. 8 is similar to that shown in FIG. 1. When the drill string is lifted off the hole bottom, the packing means 36 slides downwardly, opening the ports 52 and permitting drilling fluid to flow from the pipe annulus 30 into the hole annulus 54. A portion of the drilling fluid, however, will continue down the pipe annulus 30 and out the jet nozzle 64.

Figure 9:
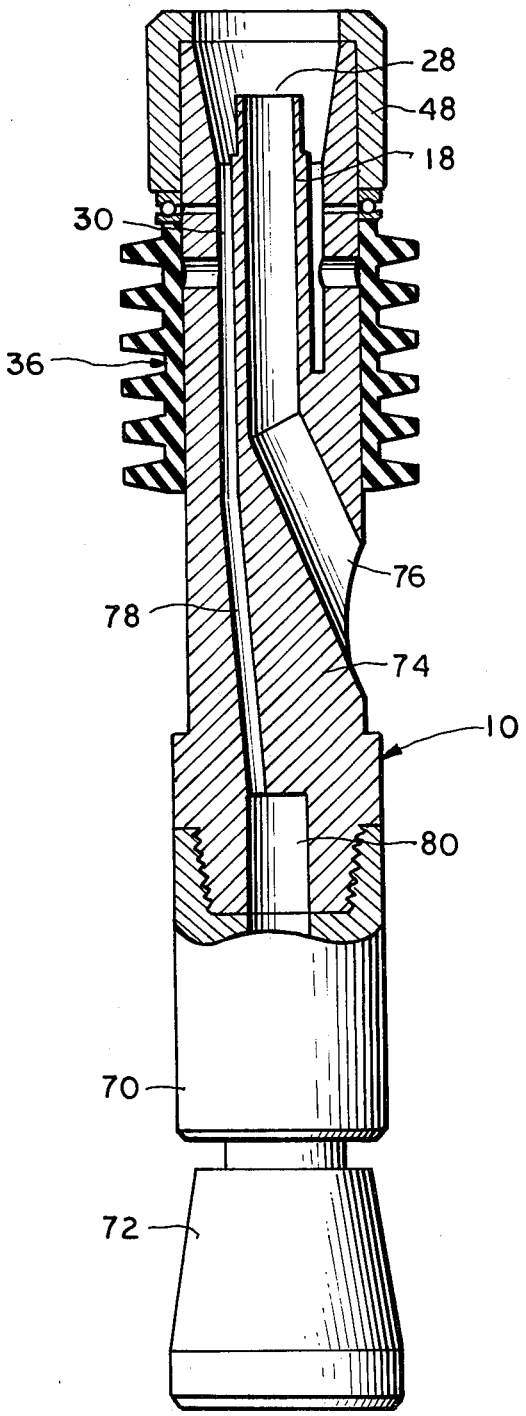
FIG. 9 is a view similar to FIG. 1, showing yet another construction embodying the invention.

FIG. 9 shows still another embodiment of the bit packer 10. In this embodiment, the bit packer is adapted for use with a down hole motor. In the particular embodiment illustrated, the down hole motor constitutes a fluid hammer 70 which is used to drive a conventional hammer bit 72 which reciprocates against the bottom of the hole as the drill string rotates. Inasmuch as the hammer bit 72 does not permit return of cuttings upwardly therethrough, the central conduit 28 within the inner tubular member 18 is diverted through the body 74 of the bit packer sub 10 by means of a pot 76 which provides communication with the hole annulus 54. The pipe annulus 30 is extended by means of one or more passageways 78 to a chamber 80. Thus, fluid passing down the pipe annulus 30 and through the passageway 78 into the chamber 80 is available to provide driving energy to the fluid hammer 70. The exhaust fluid from the hammer 70 is discharged through or in the vicinity of the bit 72, assisting in the cutting process, and carries entrained cuttings upwardly in the hole annulus 54 to the port 76 and thence to the surface through the central opening 28.

It should be understood that the bit packer of the present invention may be adapted for use with virtually any type of bit, in addition to those illustrated in the drawings. For example, the embodiment shown in FIG. 1 could be used in conjunction with a conventional diamond coring bit, or with drag bits and fish tail bits. Similarly, the embodiment of FIG. 9 could be used with any type of down hole equipment wherein a fluid motor is employed.

I claim:

1. A bit packer for use with a string of dual concentric drill pipe above a bit comprising:

an inner tubular member including means for providing fluid-tight interconnection with the inner pipe of said string to provide a conduit for drilling fluid and cuttings from bit to surface;

an outer tubular member arranged concentrically with said inner member and including means for providing fluid-tight interconnection with the outer pipe of said string to provide an annular conduit for drilling fluid from surface to bit;

packing means encircling said outer member and adapted to contact the hole wall and seal the annular space between the hole wall and the outer member;

bearing means for mounting said packing means rotatably with respect to said outer member; and means for providing a flow of drilling fluid from said annular conduit to said bearing means.

2. A bit packer in accordance with claim 1, including a milling collar mounted on said outer member above said packing means.

3. A bit packer in accordance with claim 1, wherein said packing means comprises a plurality of flexible rings of diameter greater than the hole.

4. A packer for use with a string of dual concentric drill pipe comprising:

a cylindrical body;

means defining a first passageway in said body communicating with the annular conduit between the inner and outer pipes of said string to provide a first flow path from surface to bit;

means defining a second passageway in said body communicating with the inner pipe of said string to provide a second flow path, isolated from said first flow path, to permit cuttings to be carried from the bit vicinity to surface;

means at the bottom of said body for receiving a bit;

packing means mounted rotatably on said body above said bit to seal the annular space between said body and the hole wall; and a milling collar mounted on said body above said packing means.

5. A packer for use with a string of dual concentric drill pipe above a bit comprising:

an inner tubular member including means for providing fluid-tight interconnection with the inner pipe of said string to provide a conduit for drilling fluid and cuttings from bit to surface;

an outer tubular member arranged concentrically with said inner member and including means for providing fluid-tight interconnection with the outer pipe of said string to provide an annular conduit for drilling fluid from surface to bit;

packing means encircling said outer member and adapted to contact the hole wall and seal the annular space between the hole wall and the outer member, said packing means being mounted rotatably with respect to said outer member; and first port means in said outer member providing fluid communication between said annular conduit and said annular space, wherein said packing means is slidably mounted on said outer member to close said port means to fluid flow when the bit is in drilling position at the hole bottom and to open said port means when said bit is lifted up from the hole bottom.

6. A bit packer in accordance with claim 5, including second port means in said outer member providing fluid communication between said annular conduit and said annular space, wherein said second port means is positioned below said first port means such that slidable movement of said packing means to open said first port means will close said second port means and vice-versa.

7. A packer for use with a string of dual concentric drill pipe comprising:

a cylindrical body;

means defining a first passageway in said body communicating with the annular conduit between the inner and outer pipes of said string to provide a first flow path from surfact to bit;

means defining a second passageway in said body communicating with the inner pipe of said string to provide a second flow path, isolated from said first flow path, to permit cuttings to be carried from the bit vicinity to surface;

packing means mounted rotatably on said body above said bit to seal the annular space between said body and the hole wall; and port means in said body providing fluid communication between said first passageway and said annular space, wherein said packing means is slidably mounted on said body and cooperates frictionally with the hole wall to slide upwardly and downwardly on said body to respectively close and open said port means when said body is moved respectively downwardly and upwardly in said hole.

8. A packer for use with a string of dual concentric drill pipe comprising:

a cylindrical body;

means defining a first passageway in said body communicating with the annular conduit between the inner and outer pipes of said string to provide a first flow path from surface to bit;

a second passageway in said body communicating with the inner pipe of said string to provide a second flow path, isolated from said first flow path, to permit cuttings to be carried from the bit vicinity to surface;

means at the bottom of said body for receiving a bit;

packing means mounted rotatably on said body above said bit to seal the annular space between said body and the hole wall; and port means in said body to provide fluid communication between said annular space and said second passageway.

9. A bit packer in accordance with claim 8, including means for interconnecting said first passageway with a fluid motor for driving said bit.

10. A packer for use with a string of dual concentric drill pipe comprising:

a cylindrical body;

means defining a first passageway in said body communicating with the annular conduit between the inner and outer pipes of said string to provide a first flow path from surface to bit;

means defining a second passageway in said body communicating with the inner pipe of said string to provide a second flow path, isolated from said first flow path, to permit cuttings to be carried from the bit vicinity to surface;

packing means mounted rotatably on said body above said bit to seal the annular space between said body and the hole wall; and port means in said body providing fluid communication between said first passageway and said annular space.

* * * * *